US006110082A

United States Patent [19]

Tsai

[11] Patent Number: 6,110,082

[45] Date of Patent: Aug. 29, 2000

[54] MULTIFUNCTIONAL EXERCISE DEVICE

[76] Inventor: Ching-Fa Tsai, No. 25, Lane 330, Yatan Rd., Taya Hsiang, Taichung Hsien, Taiwan

[21] Appl. No.: 09/356,238

[22] Filed: Jul. 16, 1999

[51] Int. Cl.[7] ..... A63B 21/02

[52] U.S. Cl. ..... 482/121; 482/126; 482/128

[58] Field of Search ..... 482/121, 122, 482/126, 51, 54, 57, 127, 148

[56] References Cited

U.S. PATENT DOCUMENTS

| | | | |
|---|---|---|---|
| 5,295,935 | 3/1994 | Wdng | 482/126 |
| 5,651,755 | 7/1997 | Chen | 482/126 |
| 5,690,597 | 11/1997 | En Faradi | 482/126 |
| 5,700,232 | 12/1997 | Clausen et al. | 482/126 |
| 5,746,686 | 5/1998 | Berman et al. | 482/126 |
| 5,911,535 | 6/1999 | Gvoich | 482/124 |
| 5,954,622 | 9/1999 | Olshansky et al. | 482/126 |
| 5,993,361 | 11/1999 | Paoli et al. | 482/126 |

*Primary Examiner*—Jerome Donnelly
*Attorney, Agent, or Firm*—Jackson Walker L.L.P.

[57] ABSTRACT

An exercise device comprising two guide members each including an elongated guide track, two handles each including a body slidably mounted to the guide track of one of the two corresponding guide members, and multiple elastic ropes each having a first end secured to the guide track of one of the corresponding guide members, and the second end secured to the body of one of the corresponding handles to move therewith.

8 Claims, 6 Drawing Sheets

MULTIFUNCTIONAL EXERCISE DEVICE

CROSS-REFERENCES TO RELATED APPLICATIONS

Not Applicable.

BACKGROUND OF THE INVENTION

1. Field of the Invention

The present invention relates to a multifunctional exercise device.

2. Description of the Related Art

Sometimes, our exercise activities are restricted to being performed indoors because of heavily congested urban areas or bad weather, therefore, it is necessary to provide an exerciser which can be used indoors. However, a conventional exercise machine occupies a lot of space and cannot be adjusted easily, thereby causing a great waste of space.

A conventional exercise device includes two handles, and multiple compression springs connected between the two handles. In operation, a user can pull the compression springs outward in a horizontal manner with his two hands holding the two handles, thereby exercising his chest and arm muscle. Sometimes, some of the compression springs need to be removed from the handles to meet the user's requirements. However, it is not easy to remove the compression springs from the handles, thereby decreasing the versatility of the exercise device. In addition, the user's body is easily pinched by the compression springs during exercises, thereby injuring the user. The present invention has arisen to mitigate and/or obviate the disadvantage of the conventional exercise device.

BRIEF SUMMARY OF THE INVENTION

In accordance with one aspect of the present invention, there is provided a exercise device comprising two guide members each including an elongated guide track, two handles each including a body slidably mounted to the guide track of one of the two corresponding guide members, and multiple elastic ropes each having one end secured to the guide track of one of the corresponding guide members, and the other end secured to the body of the other corresponding handle to move therewith.

Further benefits and advantages of the present invention will become apparent after a careful reading of the detailed description with appropriate reference to the accompanying drawings.

DETAILED DESCRIPTION OF THE INVENTION

Figure 1:
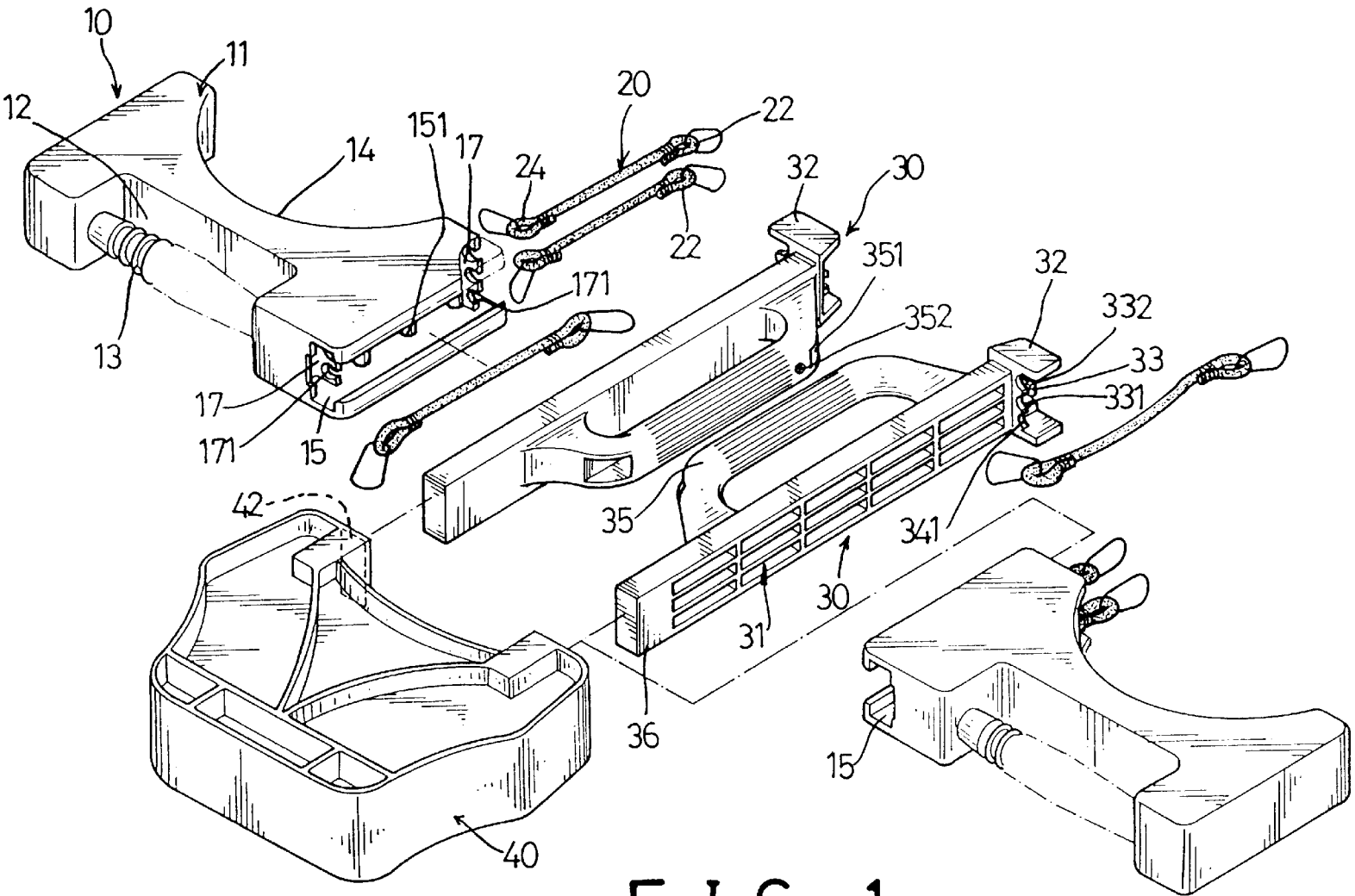
FIG. 1 is an exploded perspective view of an exercise device in accordance with the present invention.

Referring to the drawings and initially to FIGS. 1–4, an exercise device in accordance with the present invention comprises two guide members (30) each including an elongated guide track (31), two handles (10) each including a body (11) slidably mounted to the guide track (31) of one of the two corresponding guide members (30), and multiple elastic ropes (20) each having the first end (22) secured to the guide track (31) of one of the two corresponding guide members (30), and the second end (24) secured to the body (11) of one of the two corresponding handles (10) to move therewith.

The body (11) of each of the two handles (10) has a first end, a second end, a first side and a second side, the first end containing a chamber (15) therein, and two retaining pieces (17) each received in the chamber (15) and each containing multiple retaining recesses (171) therein. The retaining recess (171) of one of the two retaining pieces (17) is used to retain the second end of the respective elastic rope (20) therein. Each of the two handles (10) includes multiple abutting posts (151) mounted in the chamber (15) each abutting the elastic rope (20).

The body (11) of each of the two handles (10) contains a rectangular recess (12) defined in the first side thereof, and an arcuate recess (14) defined in the second side thereof, and each of the two handles (10) includes a handgrip (13) secured in the rectangular recess (12).

Figure 3:
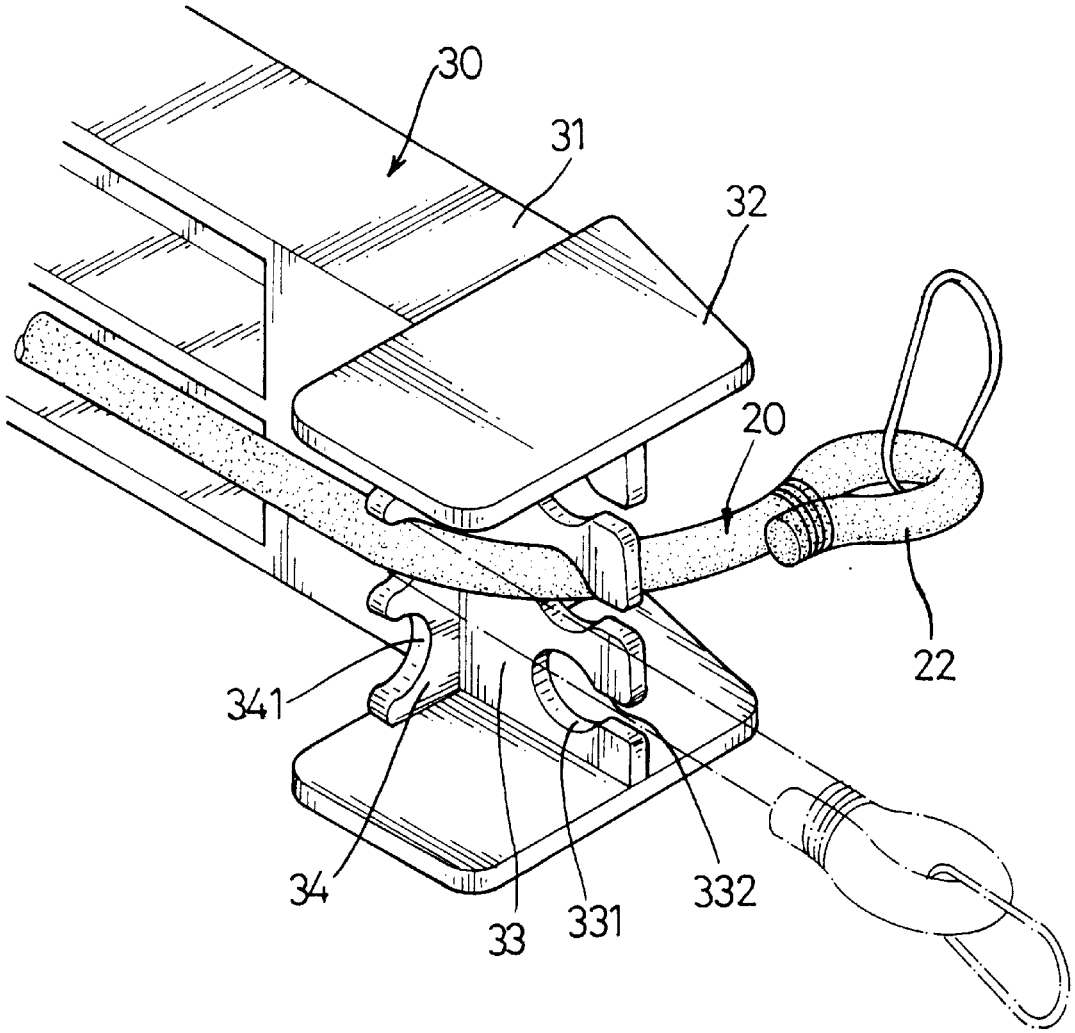
FIG. 3 is a perspective assembly view of the elastic rope being connected to the guide member of the exercise device in FIG. 1.

The guide track (31) of each of the two guide members (30) has a first end formed with a retaining base (32) to limit further movement of the body (11) of the respective handle (10), and a second end formed with an insert (36). Referring to FIG. 3, the retaining base (32) includes a locking piece (33) containing multiple locking slots (331) each receiving the first end (22) of the respective elastic rope (20), and each of the locking slots (331) contains a slit (332) to allow the elastic rope (20) to be inserted into the slot (331). The slit (332) has a dimension smaller than the diameter of the respective elastic rope (20).

The guide track (31) of each of the two guide members (30) includes a support piece (34) mounted on the first end thereof, and the support piece (34) contains multiple arcuate opening (341) each receiving an elastic rope (20) therein.

The exercise device also comprises an abdomen abutting block (40) containing two sockets (42) each detachably receiving the insert (36) of the guide track (31) of one of the corresponding guide members (30) therein.

Figure 2:
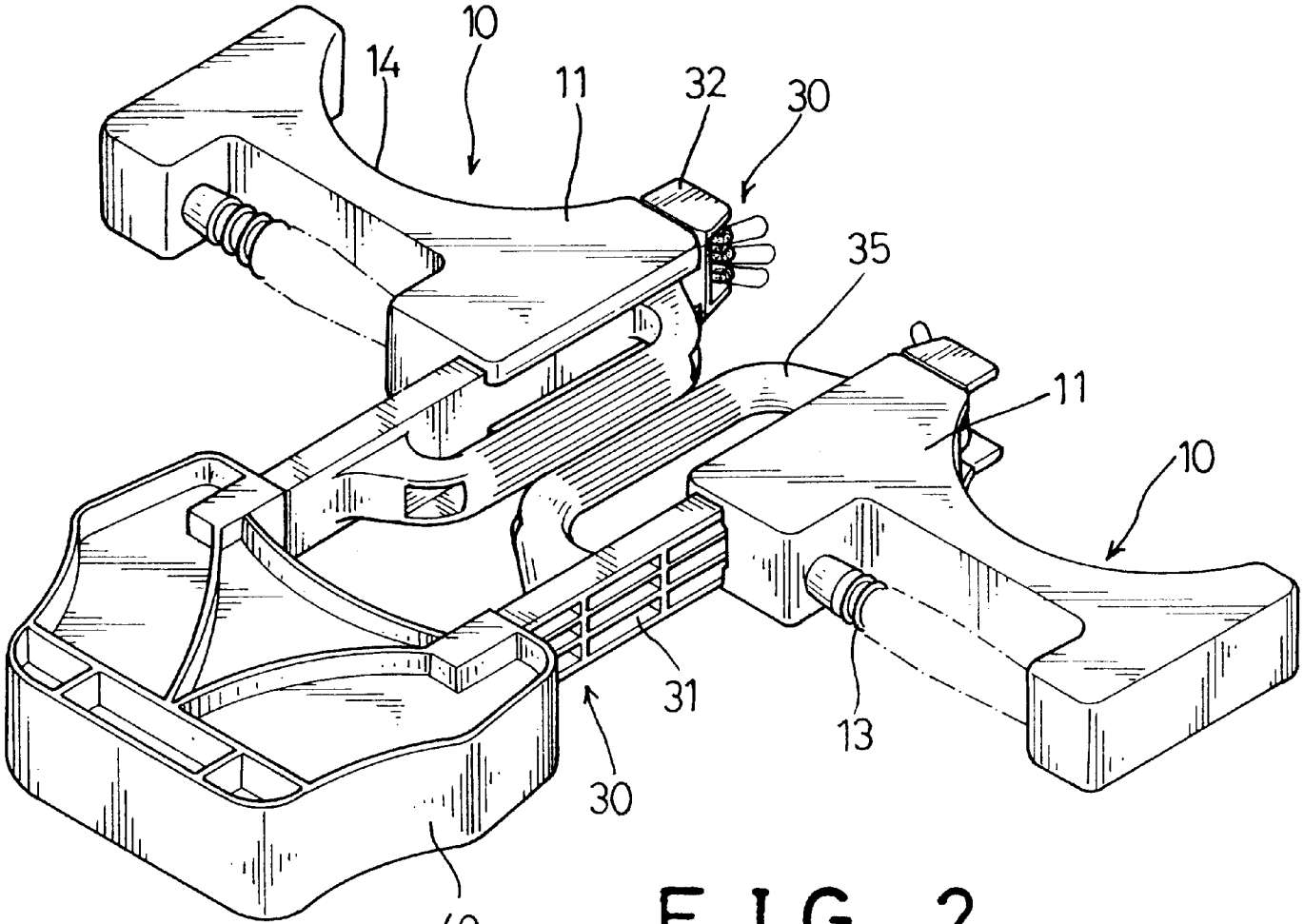
FIG. 2 is a perspective assembly view of the exercise device in FIG. 1.
Figure 4:
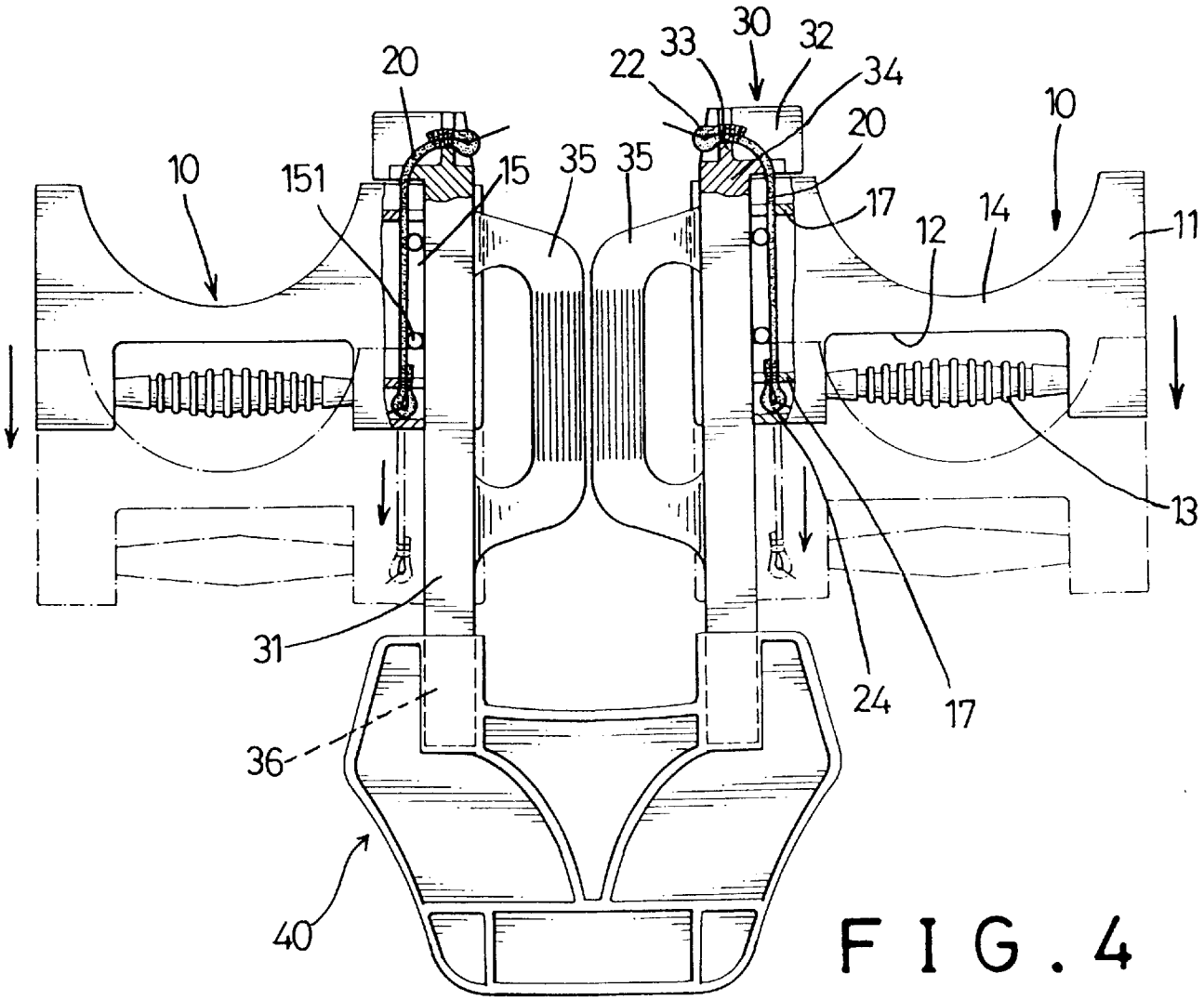
FIG. 4 is a top plan operational view of the exercise device in FIG. 2.

In operation, referring to FIG. 4 with reference to FIGS. 1–3, a user holds the handgrips (13) with his two hands, with the abdomen abutting block (40) pressing his abdomen. The user then exerts a force on the handgrips (13) with his two hands to move the body (11) of each of the two handles (10) on the guide track (31) of the respective guide member (30) from the position as shown in solid lines to the position as shown in phantom lines so as to press his abdomen, thereby exercising his abdominal region. The body (11) of each of the two handles (10) is returned to its original position by the restoring force of the elastic ropes (20).

Figure 5:
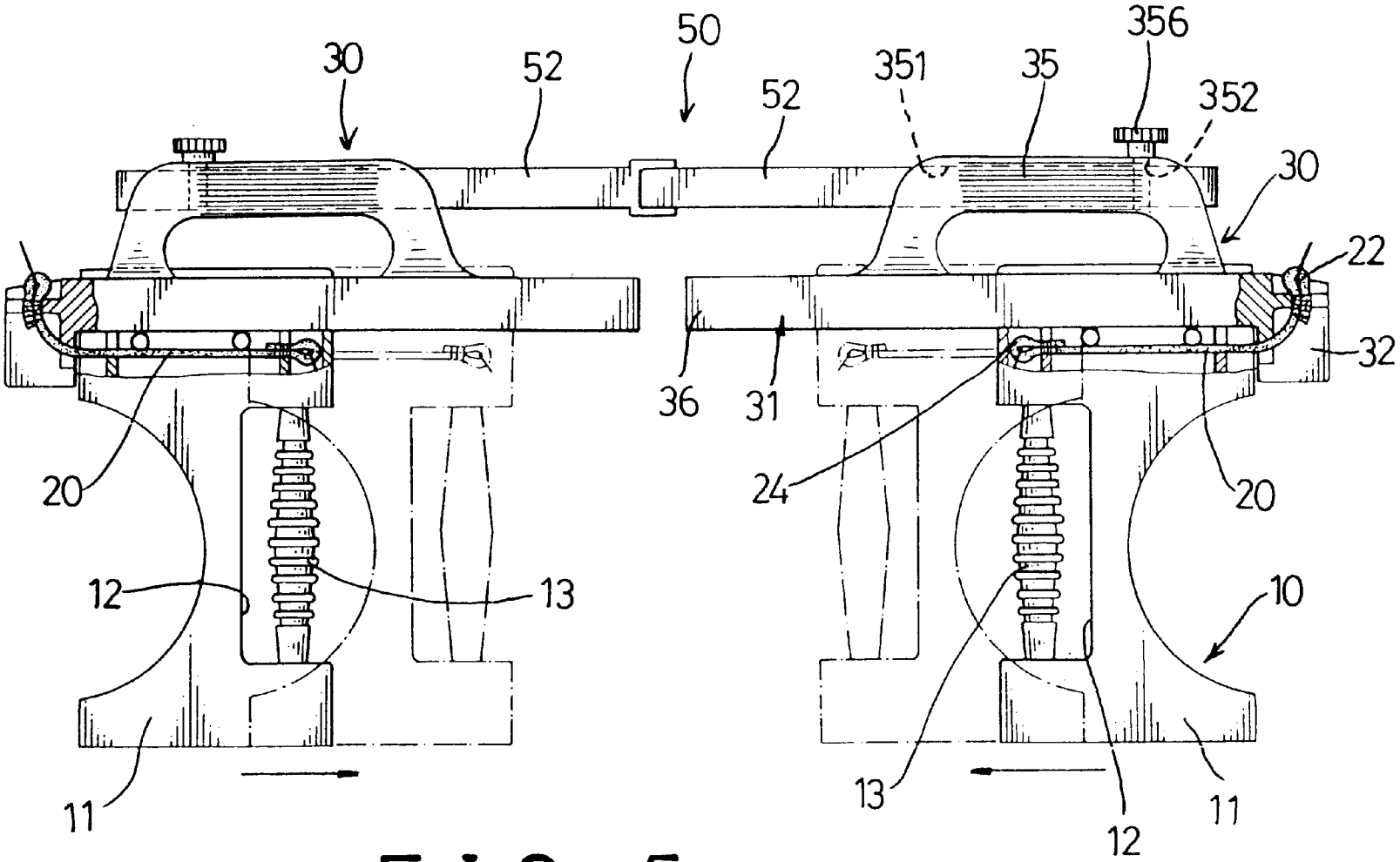
FIG. 5 is a top plan operational view of the exercise device in accordance with another embodiment of the present invention.

Referring to FIG. 5 with reference to FIG. 1, the abdomen abutting block (40) is removed from the exercise device. Each of the two guide members (30) includes a connector (35) formed on the guide track (31) and containing an elongated guide channel (351). The exercise device comprises a linking member (50) including two levers (52) pivotally connected with each other, and each having a distal end secured in the guide channel (351) of the connector (35) of one of the corresponding guide members (30).

The connector (35) of each of the two guide members (30) contains a threaded bore (352) connecting to the guide channel (351), and the exercise device comprises two locking screws (356) each screwed into the threaded bore (352) of one of the two guide member (30) and each abutting one of the two corresponding levers (52) of the linking member (50), thereby securing each of the two levers (52) to the connector (35) of each of the two guide members (30).

As shown in FIG. 5, the rectangular recesses (12) of the body (11) of the two handles (10) face each other.

In operation, the user exerts a force on the handgrips (13) with his two hands to move the body (11) of each of the two handles (10) toward each other on the guide track (31) of the respective guide member (30) from the position as shown in solid lines to the position as shown in phantom lines, thereby exercising his arm muscle. The body (11) of each of the two handles (10) is returned to its original position by the restoring force of the elastic ropes (20).

Figure 6:
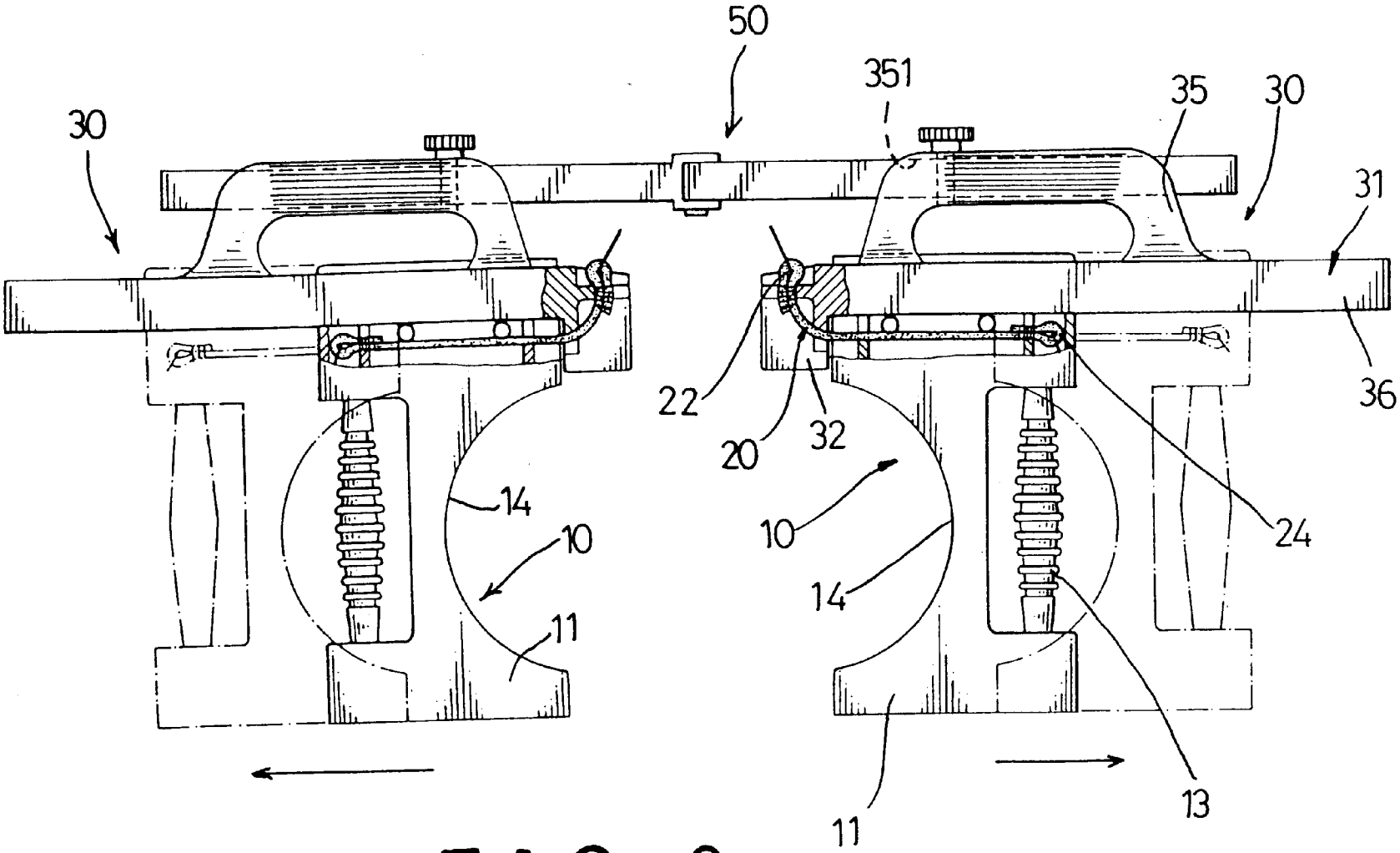
FIG. 6 is a top plan operational view of the exercise device in accordance with another embodiment of the present invention.

Referring to FIG. 6 with reference to FIG. 5, the arcuate recesses (14) of the body (11) of the two handles (10) face each other.

In operation, the user exerts a force on the handgrips (13) with his two hands to move the body (11) of each of the two handles (10) outward relative to each other on the guide track (31) of the respective guide member (30) from the position as shown in solid lines to the position as shown in phantom lines, thereby exercising his chest. The body (11) of each of the two handles (10) is returned to its original position by the restoring force of the elastic ropes (20).

Alternatively, the user places his two legs into the arcuate recess (14) of the respective handle (10) to exert a force on the body (11) so as to move the body (11) of each of the two handles (10) outward relative to each other on the guide track (31) of the respective guide member (30) from the position as shown in solid lines to the position as shown in phantom lines, thereby exercising his legs.

It should be clear to those skilled in the art that further embodiments may be made without departing from the scope and spirit of the present invention.

What is claimed is:

1. An exercise device comprising:

two guide members (30) each including an elongated guide track (31);

two handles (10) each including a body (11) slidably mounted to said guide track (31) of one of said two corresponding guide members (30);

said body (11) of each of said two handles (10) having a first end, a second end, a first side and a second side, said first end containing a chamber (15) therein, at least one retaining piece (17) received in said chamber (15) and containing at least one retaining recess (171) to retain said second end of said respective elastic rope (20) therein;

each of said two handles (10) including multiple abutting posts (15) mounted in said chamber (15) each abutting said elastic rope (20); and multiple elastic ropes (20) each having a first end (22) secured to said guide track (31) of one of said two corresponding guide members (30), and the second end (24) secured to said body (11) of one of said corresponding handles (10) to move therewith.

2. The exercise device in accordance with claim 1, wherein said body (11) of each of said two handles (10) contains a rectangular recess (12) defined in the first side thereof, and an arcuate recess (14) defined in the second side thereof, and each of said two handles (10) includes a handgrip (13) secured in said rectangular recess (12).

3. The exercise device in accordance with claim 1, wherein said guide track (31) of each of said two guide members (30) has a first end formed with a retaining base (32), and a second end formed with an insert (36), said retaining base (32) includes a locking piece (33) containing multiple locking slots (331) each receiving said first end (22) of said respective elastic rope (20) therein, and each of said locking slots (331) contains a slit (332) to allow said elastic rope (20) pass therethrough.

4. The exercise device in accordance with claim 3, wherein said slit (332) has a dimension smaller than the diameter of said respective elastic rope (20).

5. The exercise device in accordance with claim 3, wherein said guide track (31) of each of said two guide members (30) includes a support piece (34) mounted on the first end thereof, and said support piece (34) contains multiple arcuate opening (341) each receiving said respective elastic rope (20) therein.

6. The exercise device in accordance with claim 3, further comprising an abdomen abutting block (40) containing two sockets (42) each receiving said insert (36) of said guide track (31) of one of said corresponding guide members (30) therein.

7. The exercise device in accordance with claim 3, wherein each of said two guide members (30) includes a connector (35) mounted to said guide track (31) and containing an elongated guide channel (351), and said exercise device further comprises a linking member (50) including two levers (52) pivotally connected with each other, and each having a distal end secured in said guide channel (351) of said connector (35) of one of said corresponding guide members (30).

8. The exercise device in accordance with claim 7, wherein said connector (35) of each of said two guide members (30) contains a threaded bore (352) connecting to said guide channel (351), and said exercise device further comprises two locking screws (356) each screwed into said threaded bore (352) of one of said two guide member (30) and each abutting one of said two corresponding levers (52) of said linking member (50).

* * * * *